US005497795A

United States Patent [19]

Hibbard

[11] Patent Number: 5,497,795

[45] Date of Patent: Mar. 12, 1996

[54] METHOD AND APPARATUS OF BRAIDING HAIR

[76] Inventor: Lynda D. Hibbard, 3813 N. Lake Orlando Pkwy., Orlando, Fla. 32808

[21] Appl. No.: 296,449

[22] Filed: Aug. 26, 1994

[51] Int. Cl.[6] ..... A45D 8/12

[52] U.S. Cl. ..... 132/200; 132/275; 132/212; D28/41

[58] Field of Search ..... 132/200, 273, 132/275, 212; D28/39, 41

[56] References Cited

U.S. PATENT DOCUMENTS

| | | | |
|---|---|---|---|
| D. 220,019 | 2/1971 | Solomon | D86/10 |
| D. 348,331 | 6/1994 | Marrese | D28/41 |
| D. 353,226 | 12/1994 | Nahoum | D28/41 |
| 1,393,448 | 10/1921 | Kietz . | |
| 1,408,146 | 2/1922 | Thompson . | |
| 1,724,249 | 8/1929 | Baldwin . | |
| 2,063,299 | 12/1936 | Clinch, Sr. . | |
| 2,669,239 | 2/1954 | Smith . | |
| 3,751,769 | 8/1973 | Reiner | 132/273 |
| 5,379,782 | 1/1995 | Tabb | 132/275 |

*Primary Examiner*—John G. Weiss
*Attorney, Agent, or Firm*—William M. Hobby, III

[57] ABSTRACT

A method of french braiding hair includes the step of selecting a braiding aid having a plurality of flexible and resilient loops, each loop connected to the next loop in a series and each loop being individually expandable. A person's hair has separated therefrom one strand of hair which is passed through the selective braiding aid first loop and separating the one strand of hair into two crossed strands. The first loop is then released and two strands of hair, each including a portion of the strand passing through the first loop, is passed through the second loop while the second loop is expanded with the thumb and forefinger. The second loop is released and the hair is worked through the remaining loops in this fashion until a person's hair is french braided. A braiding aid apparatus includes a plurality of four or more flexible resilient loops, each loop connected to the next loop in series and each being individually expandable and at least one loop having a decorative member attached thereto so that hair can be french braided through the braiding aid by expanding each loop one at a time while drawing overlapping strands of hair through each loop.

6 Claims, 2 Drawing Sheets

METHOD AND APPARATUS OF BRAIDING HAIR

BACKGROUND OF THE INVENTION

The present invention relates to a method and apparatus for french braiding hair and especially to a method of french braiding hair using a braiding aid having a plurality of connected elastic loops.

Braiding is a process of interweaving three or more strands of strips or lengths of hair or the like in a diagonally overlapping pattern in order to style a person's hair by the interweaving of the hair. In the present invention, a hair braiding method and apparatus is used for french braiding hair in a predetermined pattern which is both simple and rapid. In the past, there has been a wide variety of prior U.S. patents where a hair braiding or styling apparatus has been suggested. The Sapkus U.S. Pat. No. 4,369,690, is for a Hair Braiding Apparatus which is hand-held and hand-operated but which passes strands of hair through a plurality of apertures to interweave and braid the hair in a predetermined pattern. In the Reiner U.S. Pat. No. 3,751,769, a Fastening Device is provided for tying a ponytail which includes two centrally connected resilient loops and in which each loop has an enlargement at its outer end, such that one enlargement can be snapped over the other. In the Harriett U.S. Pat. No. 5,167,245, a Hair Tying Apparatus and Method is provided which includes a needle and a hair tie. The hair tie has one tie strand attached to an elastic loop so that the device can be used to tie the tie strand around a portion of a person's hair. The Edmark U.S. Pat. No. 5,036,870, is for a Styling Tool for inverting a hair tail to provide a specific hair style. The Hoffmann U.S. Pat. No. 3,301,266, is for a Hair Holder similar to the Reiner patent which has a cord with two enlarged end members which can be wrapped around a portion of hair to tie the hair into a ponytail. The Obergfell U.S. Pat. No. 4,998,544, is for a combination headband and ponytail holder. A design patent to Solomon, No. D 220,019, shows a Flexible Hair Holder having a pair of loops connected with a central strand and having a ball on each of the loops. The Kietz U.S. Pat. No. 1,393,448, shows a Device for Waving Hair having a plurality of interconnecting wire loops. The Thompson U.S. Pat. No. 1,408,146, is a Hair Wave Former in which strands of hair are looped around a two-pronged device for waving the hair. The Baldwin U.S. Pat. No. 1,724,249, is a Marcel Hair Waver having a flat member with a plurality of slots for wrapping the hair therearound and onto the hair waver where it is strapped with a rubber band. The Clinch, Sr. U.S. Pat. No. 2,063,299, is a Trimming technique which braids a cord around a core strand. The Cecil U.S. Pat. No. 2,910,990, shows a Hair Waving Device, having a pair of connected loops. The Aniszewski et al. U.S. Pat. No. 4,230,133, is for a Hair Curler having a hairpin shape with an undulated outer side shaped for the placement of hair.

In contrast to these prior patents, the present invention is directed towards a french braiding aid for french braiding hair in a particular pattern. Using the braiding aid allows for the rapid braiding of the hair in a particular pattern with a reduced amount of skill. The braiding aid also allows for a plurality of decorative ornaments to be spaced in the hair as finally braided.

SUMMARY OF THE INVENTION

A method of french braiding hair includes the step of selecting a braiding aid having a plurality of flexible and resilient loops, each loop connected to the next loop in a series and each loop being individually expandable. A triangular section of hair is gathered at the center of the frontal hairline and the thumb and forefinger of either hand are inserted through the first expandable loop of the braiding aid to pull the gathered hair section from under and through the first loop of the braiding aid. This first strand is divided in half and criss-crossed through the first loop. Next a first rectangular section of hair (about 1") is selected and isolated next to the beginning triangular section on the right side of the head. This section of hair is added to the criss-crossed section on the right side of the head and by using the thumb and forefinger of the left hand, the new combined strand is pulled under and through the second loop. The first (1") rectangular section of hair on the left side of the head is selected and added to the remaining criss-crossed hair from the first loop. The thumb and forefinger of the right hand is used to pull this hair under and through the second loop. All the hair pulled through the second loop is naturally criss-crossed and remains separated. Moving to the next loop, alternate (1") rectangular sections from the right side and then the left side of the head are repeated to complete the second loop and continued until all the hair has been french braided. A braiding aid apparatus includes a plurality of four or more flexible resilient loops, each loop connected to the next loop in series and each being individually expandable and at least one loop can have a decorative member attached thereto so that hair can be french braided through the braiding aid by expanding each loop one at a time while drawing overlapping strands of hair through each loop.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
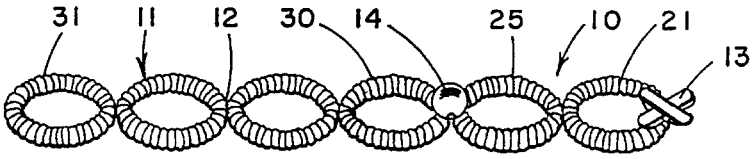
FIG. 1 is a side perspective view of a braiding aid in accordance with the present invention.
Figure 2:
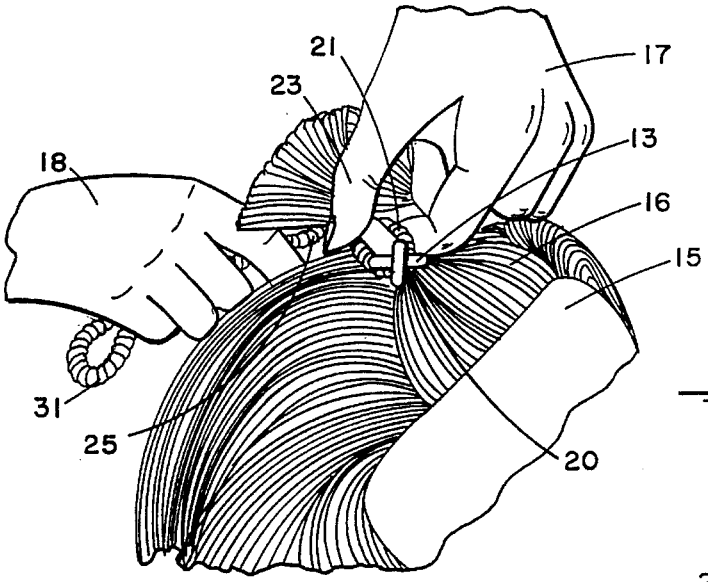
FIG. 2 is a partial perspective of the first step in braiding hair using the braiding aid of FIG. 1.

Referring to the drawings and especially to FIG. 1, a braiding aid 10 has a plurality of loops 11 connected through attachments 12 to each other to form one continuous set of loops. Each loop is made of a flexible and resilient or elastic material allowing it to be individually stretched separate from the other loops. An ornamental member 13 is attached to one end of the string of loops, which ornamental end 13 can also be used to readily identify the end and to hold the braiding aid 10. A second ornamental member 14 is placed between a pair of loops and other ornamental pieces can be placed between any or all the connecting points 12 between pairs of loops. A typical french braiding aid in accordance with the present invention would have six or more loops and might typically have eight loops connected in series, one to the other. The loops 11 include a first loop 21 connected to a second loop 25 which is connected to a third loop 30.

Figure 3:
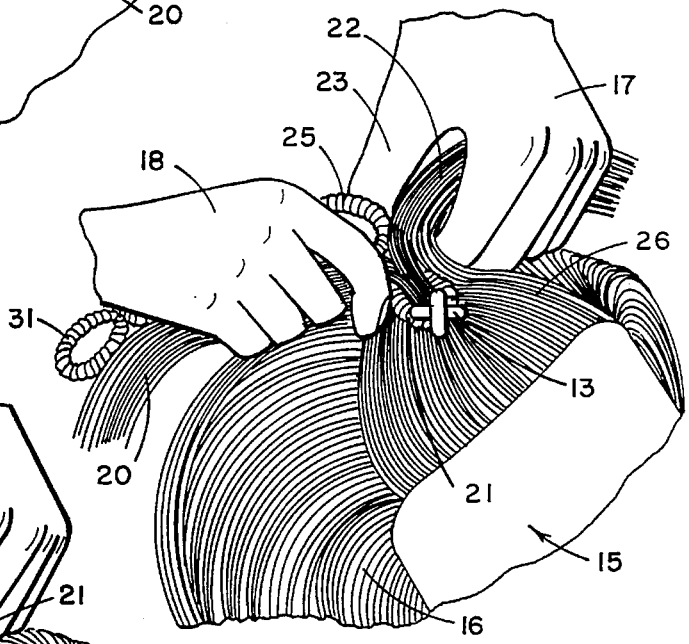
FIG. 3 is a partial perspective of a second step in the braiding of the hair.
Figure 4:
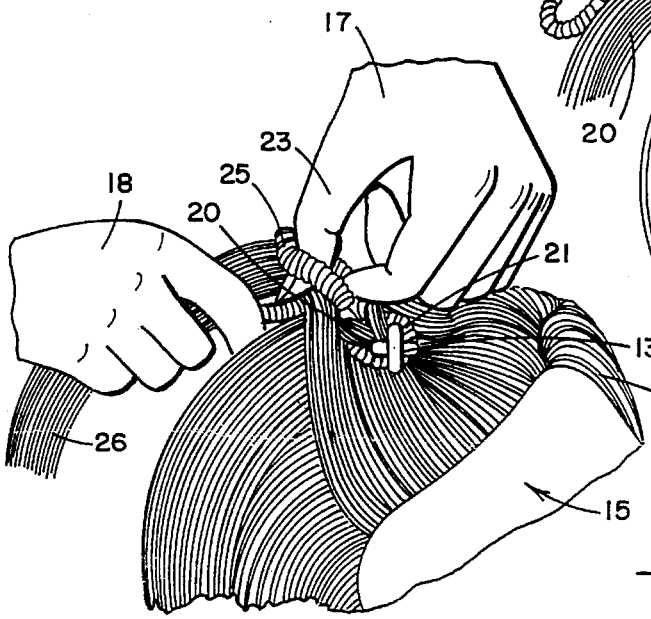
FIG. 4 is a partial perspective of the braiding process entering the second loop of the aid of FIG. 1.
Figure 5:
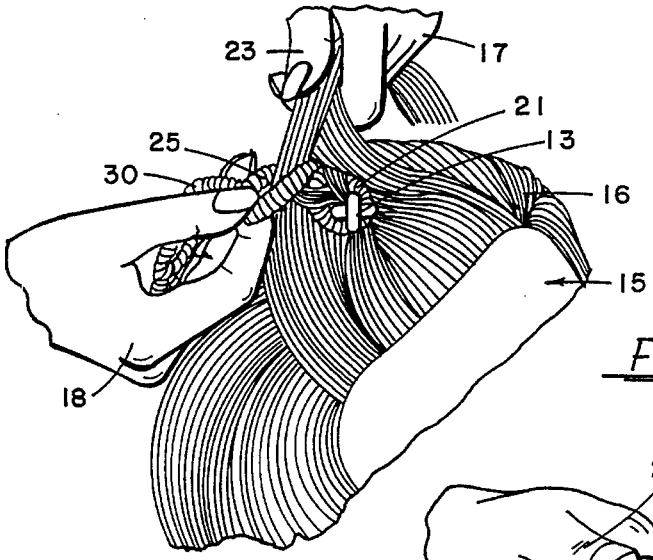
FIG. 5 is a partial perspective of the continued process of braiding the hair through the second loop of the braiding aid.
Figure 6:
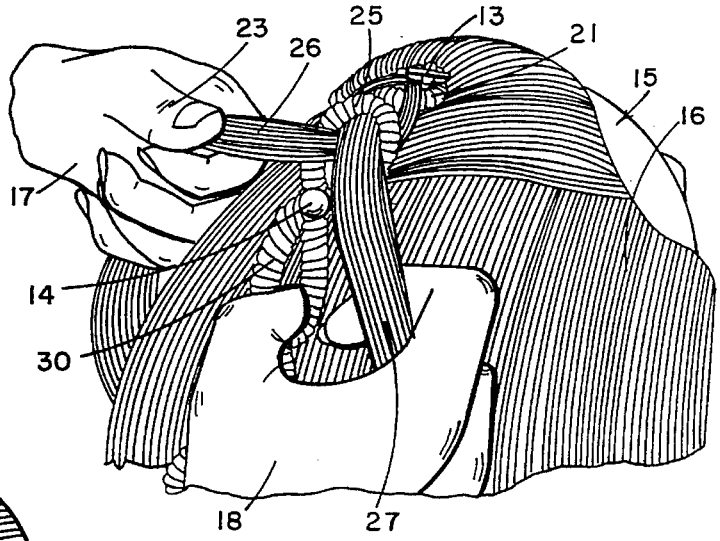
FIG. 6 is a partial perspective of the braiding through the third loop of the braiding aid of FIG. 1.

The process of using the braiding aid of FIG. 1 is shown in FIGS. 2–8. A person's head 15 has long hair 16 being braided by a pair of hands 17 and 18. A strand of hair 20 is gathered up by the hands 17 and 18 in FIG. 2 and pulled through the first loop 21 having the decorative member 13 at the top for the beginning of the braiding process. The strand 20 is a grouping of hair which is pulled through the loop 21 which loop may be expanded or stretched to allow it to pull through more easily. When the first strand 20 is pulled through the loop, it is divided into two equal parts and criss-crossed as seen in FIG. 3. Hand 18 in FIG. 3 selects a rectangular strand (about 1") of hair 22 from the right side of the head 15, and combines this selected strand with the portion pulled through and criss-crossed to the right side of the head from strand 20 in FIG. 2. Hand 17 in FIG. 3 then uses the thumb and forefinger to expand loop 25 in FIG. 4. Hand 17 in FIG. 5 selects a rectangular strand 26 of about 1" of hair from the left side of the head 15 and combines this selected strand with the remaining hair pulled through and crossed to the left from strand 20 (FIG. 3). The thumb and forefinger of the hand 18 of FIG. 6 are used to expand loop 25 and the combined selection from strands 20 and 26 are pulled under and through loop 25 in FIG. 5.

Figure 7:
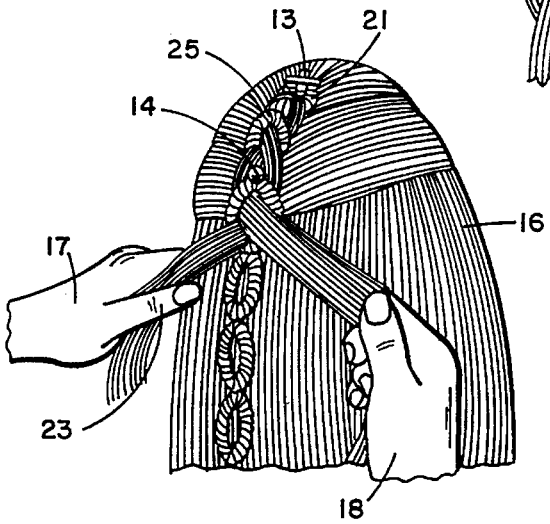
FIG. 7 is a rear perspective of the braiding through the third loop of the braiding aid of FIG. 1.

A second strand 27 is being pulled through the second loop in FIG. 6 while the thumb of the hand 18 is pulling on the third loop 30 to prepare it for the next two strands of hair in which the strand 27 will be accumulated with additional hair for the third loop 30. The strand 26 is being held by the hand 17 in FIG. 6. Cross-looping through additional loops of the braiding aid 10 is seen in FIG. 7 as the process continues down the series of loops 11 until the end is reached, at which time all of the hair extending through the final loop is fed through one or two end loops 31 in FIG. 8 allowing a strand 32 to extend therebelow. Two end loops 31 are gathered so that the entire remaining strand 32 can be pushed between the expanded loop at the end of the braiding aid. The result is neatly french braided hair 33 in FIG. 8 with parallel strands of hair 34 having been braided through the braiding aid until the braiding job is complete.

Figure 8:
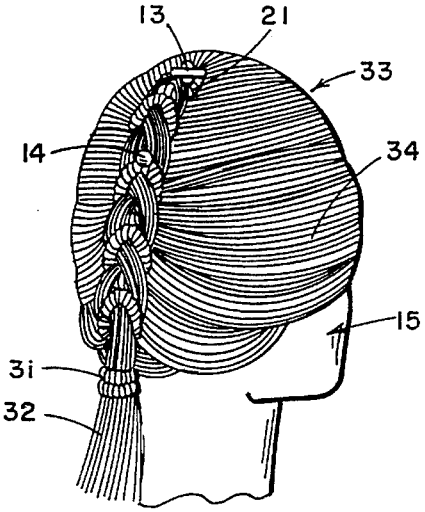
FIG. 8 is a rear perspective of the french braided hair in accordance with the present process.

As seen in FIG. 8, the end decorative element 13 appears at the top and the one decorative element 14 appears partway down and other decorative elements could appear at each point between the loops 11 as desired to give a series of decorative elements extending in regular order down the braided hair. Alternatively, the intermediate decorative elements could be left off as desired. Each loop 11 of the braiding aid 10 is made of an elastic band or cord covered with a cloth to give it flexible and elastic qualities while a cloth covering can be of any color or pattern desired to either blend with the hair or to provide a contrasting color to the hair. Similarly, the decorative elements 13 or 14 can be made of a polymer of any color desired. The loops can be attached by sewing them together at 12 or can be attached in any manner desired.

It should be clear at this point that a method of french braiding hair has been provided in which a braiding aid simplifies the process of braiding hair and allows less skilled persons to braid hair. However, it should also be clear that the present invention is not to be considered as limited to the forms shown which are to be considered illustrative rather than restrictive.

I claim:

1. A method of french braiding hair comprising the steps of:

selecting a braiding aid having a plurality of flexible, resilient loops, each loop connected to the next loop in series, and each said loop being individually expandable;

expanding said braiding aid first loop;

passing a first strand of hair through the selected braiding aid first loop in said series;

separating said first strand of hair passing through said first loop into two strands of hair;

releasing said expanded braiding aid first loop;

passing two separate strands of hair through each successive loop of said braiding aid; and crossing each two separate strands of hair passing through each successive loop one strand over the other; whereby a person's hair is french braided.

2. A method of french braiding hair in accordance with claim 1 in which the step of selecting a braiding aid includes selecting a braiding aid having at least six flexible resilient loops.

3. A method of french braiding hair in accordance with claim 1 in which the step of selecting a braiding aid includes selecting a braiding aid having a decorative element attached to one of said loops.

4. A method of french braiding hair in accordance with claim 1 in which the step of passing each two strands of hair through each successive loop of said braiding aid includes grouping an additional strand of hair with each of said two strands of hair through each successive loop following the first loop.

5. An apparatus to aid in french braiding hair comprising:

at least four flexible resilient loops, each loop connected to the next loop in series, and each said loop being individually expandable; and a plurality of decorative members attached to a plurality of said flexible resilient loops, whereby hair can be french braided by expanding each loop, one at a time while drawing overlapping strains of hair through each loop and whereby said plurality of decorative members will be displayed on said braided hair.

6. An apparatus to aid in french braiding hair in accordance with claim 5 in which said at least four flexible resilient loops is six loops.

* * * * *